US009663978B2

(12) United States Patent
Saravia Terricabras et al.

(10) Patent No.: US 9,663,978 B2
(45) Date of Patent: May 30, 2017

(54) ROTATING LATCH LOCK

(71) Applicant: FLEXNGATE AUTOMOTIVE IBERICA, S.A., Les Franqueses del Valles (ES)

(72) Inventors: Mar Saravia Terricabras, Terrassa (ES); Ramon Jalle Diaz, Castellbisbal (ES)

(73) Assignee: FLEXNGATE AUTOMOTIVE IBERICA, S.A., Les Franqueses del Valles (ES)

( * ) Notice: Subject to any disclaimer, the term of this patent is extended or adjusted under 35 U.S.C. 154(b) by 284 days.

(21) Appl. No.: 14/383,974

(22) PCT Filed: Mar. 14, 2013

(86) PCT No.: PCT/ES2013/070163
§ 371 (c)(1),
(2) Date: Sep. 9, 2014

(87) PCT Pub. No.: WO2013/140006
PCT Pub. Date: Sep. 26, 2013

(65) Prior Publication Data

US 2015/0048629 A1 Feb. 19, 2015

(30) Foreign Application Priority Data

Mar. 20, 2012 (DE) ..... 20 2012 002 867

(51) Int. Cl.
*E05C 3/06* (2006.01)
*E05C 3/12* (2006.01)
(Continued)

(52) U.S. Cl.
CPC ..... *E05C 3/12* (2013.01); *E05B 81/15* (2013.01); *E05B 83/18* (2013.01); *E05B 85/26* (2013.01);
(Continued)

(58) Field of Classification Search
CPC ..... E05C 3/12; Y10S 292/73; E05B 85/24; E05B 85/245; E05B 85/26
(Continued)

(56) References Cited

U.S. PATENT DOCUMENTS 5,295,720 A * 3/1994 Budde ..... E05B 81/22 292/201
5,520,426 A * 5/1996 Arabia, Jr. ..... E05B 77/38 292/216
(Continued)

FOREIGN PATENT DOCUMENTS

DE 103 61 168 A1 7/2005
DE 10 2006 032 033 A1 3/2007
(Continued)

OTHER PUBLICATIONS

International Search Report of PCT/ES2013/070163, dated Aug. 29, 2013. [PCT/ISA/210].

*Primary Examiner* — Carlos Lugo
(74) *Attorney, Agent, or Firm* — Sughrue Mion, PLLC

(57) ABSTRACT

A rotating latch lock having a rotatable latch retaining a closing anchor and a rotatable pawl. The lock including a transmission mechanism for moving a movable arm of the pawl towards a latch release position. The movable arm of the pawl has a flange with a distal end supported on a surface of the latch adjacent to the edge thereof, temporarily bending the flange when the latch is in a closed position retained by the pawl. The length of the flange is such that its distal end slides on the mentioned smooth surface of the latch when the movable arm of the pawl is moved to push the pawl to a release position, and is released from the latch, automatically recovering its stable form, being supported against the edge of the latch and preventing the return of the movable arm and therefore of the pawl to a closed position.

4 Claims, 2 Drawing Sheets

(51) Int. Cl.

| | |
|---|---|
| ***E05B 81/14*** | (2014.01) |
| ***E05B 83/18*** | (2014.01) |
| ***E05B 85/26*** | (2014.01) |
| *E05C 3/16* | (2006.01) |
| *E05B 85/24* | (2014.01) |

(52) U.S. Cl.
CPC ..... *E05B 85/24* (2013.01); *E05B 85/245* (2013.01); *Y10S 292/73* (2013.01); *Y10T 292/1043* (2015.04)

(58) Field of Classification Search
USPC ..... 292/95, 194, 216
See application file for complete search history.

(56) References Cited

U.S. PATENT DOCUMENTS 5,897,148 A * 4/1999 Arabia, Jr. ..... E05B 85/243 292/209
5,938,253 A * 8/1999 Szablewski ..... E05B 81/14 292/201
6,109,671 A * 8/2000 Roncin ..... E05B 81/14 292/201
6,695,362 B2 * 2/2004 Kluting ..... E05B 77/02 292/216
6,773,042 B2 * 8/2004 Spurr ..... E05B 77/02 292/201
7,467,815 B2 * 12/2008 Larsen ..... E05B 81/14 292/201
7,810,853 B2 * 10/2010 Margheritti ..... E05B 81/25 292/216
8,448,999 B2 * 5/2013 Grifoll Sauri ..... E05B 81/14 292/201
8,888,150 B2 * 11/2014 Nagaoka ..... E05B 77/38 292/340
2008/0136196 A1 * 6/2008 Pecoul ..... E05B 85/243 292/215
2011/0031765 A1 2/2011 Vazquez et al.

FOREIGN PATENT DOCUMENTS

DE 20 2006 005 282 U1 8/2007
DE 102010061427 A1 * 6/2012 ..... E05B 81/68
EP 812972 * 12/1997

* cited by examiner

ROTATING LATCH LOCK

CROSS REFERENCE TO RELATED APPLICATIONS

This application is a National Stage of International Application No. PCT/ES2013/070163 filed Mar. 14, 2013, claiming priority based on German Patent Application No. 20 2012 002 867.7, filed Mar. 20, 2012, the contents of all of which are incorporated herein by reference in their entirety.

TECHNICAL FIELD OF THE INVENTION

The invention relates to a rotating latch lock applicable to the trunk of an automotive vehicle, of the types comprising a motor-driven pawl rotating between a locked position in which it retains the latch in a closed position, and another release position in which it releases the mentioned latch. When the trunk is conveniently closed and the latch in the mentioned closed position, the latch is capable of retaining a closing anchor which prevents opening the trunk. In such locks, the pawl is subjected to the action of an associated spring which tends to arrange it in its locked position.

BACKGROUND OF THE INVENTION

Locks which, being intended particularly for taking part in closing a vehicle trunk, are provided with means to prevent the pawl from automatically adopting the locked position again, in which it prevents the movement of the latch in the opening direction thereof, when for any reason and after operating the lock for opening the trunk, it is not sufficiently moved from its normal closed position and therefore, despite having released the latch, it does not rotate in its opening direction, are known today. If the lock is not provided with these means, what would occur is that when the trunk is to be moved in a direction for opening same, the pawl would prevent it by being arranged in an automatic manner in its locked position as a result of the associated spring, preventing the movement of the latch towards its open position.

To prevent this drawback, it is possible to provide the lock with means which prevent the automatic return of the pawl to its locked position if the latch continues to adopt its closed position after operating the lock for opening the trunk. In the scope of the invention, these means are referred to as accumulation means and the mechanical solution conventionally used for such purpose are referred to as a snow load lever. This expression is suggested by the fact that the circumstance arose where the weight of snow accumulated on a trunk prevented the instantaneous movement thereof in its opening direction after operating the lock with the drawback that this entailed if the lock was not provided with means to prevent the automatic return of the pawl to its locked position.

One example of a lock provided with a snow load lever or an equivalent element is the lock described in document DE 102006032033.

The first objective of the present invention is to disclose an alternative to the mechanical solution described in document DE 102006032033.

One lock variant described in document DE 102006032033 has a trigger which can be operated by a motor pushing the pawl towards its release position during the lock opening operation. The accumulation means consist of a storage step configured in the form of a first storage rib and a second locking rib, both being concentric to one another. By arranging the pawl in its release position, a tab formed in the trigger is arranged in front of the locking rib which prevents the return of the trigger to its starting position and also of the pawl resting on the trigger.

DISCLOSURE OF THE INVENTION

The lock of the invention comprises a latch rotating between at least one closed position (A) suitable for retaining a closing anchor, and another open position (B) which releases the anchor, said latch being stressed by a first spring in the release direction; a pawl also rotating between a locked position, in which it retains the latch in the closed position, and another release position, in which it does not interfere with the rotation of the mentioned latch, the pawl being subjected to the action of a second spring which pushes it to the closed position; and transmission means suitable for moving a movable arm of the pawl in a direction transmitting a movement to the pawl from the closed position to the release position thereof, the movable arm being linked with the pawl such that the angular position of the movable arm acts as a stop for stopping the rotation of the pawl towards the locked position.

The lock is essentially characterized in that the mentioned movable arm of the pawl comprises a flange the distal end of which is supported on a smooth surface of the latch adjacent to the edge thereof, temporarily bending the flange when the latch is in its closed position retained by the pawl; and in that the length of the flange is such that its distal end slides on the mentioned smooth surface of the latch when the movable arm of the pawl is moved to push the pawl to its release position, and is released from the latch, automatically recovering its stable form, being supported against the edge of the latch and preventing the return of the movable arm and therefore of the pawl to its closed position as a result of the second spring.

In a variant of interest, the smooth surface adjacent to the edge of the latch acting on the flange is configured by way of a ramp, reducing the height of the edge of the latch in a forward direction contrary to that of the rotation of the latch towards its open position, such that the flange can again be arranged on the ramp, allowing the rotation of the pawl due to the action of the second spring which pushes it to the closed position when a portion of the ramp the smooth upper surface of which is below the level of the flange is arranged facing said flange.

According to another feature, the movable arm of the pawl is a rotating arm receiving support from the pawl subjected to the action of the second spring, elastic means which tend to move the arm towards the latch acting on the movable arm of the pawl.

In one embodiment, the elastic means comprise a third spring.

DETAILED DESCRIPTION OF A VARIANT OF THE INVENTION

Figure 1:
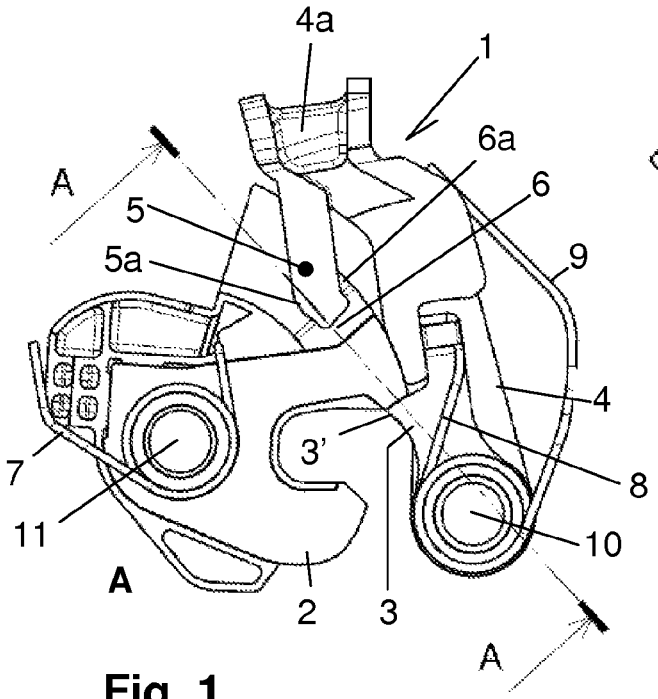
FIG. 1 is a schematic plan view of the basic components of the lock when the latch is in a closed position and prevented from moving clockwise as a result of the pawl.
Figure 2:
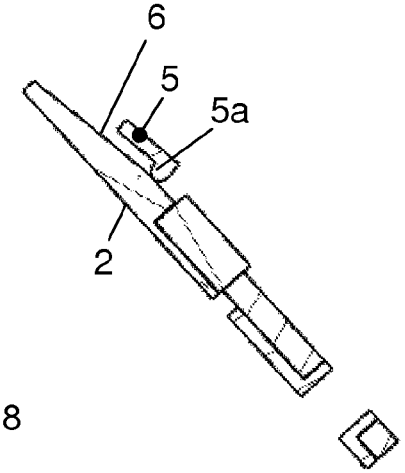
FIG. 2 is a view of the components of FIG. 1 according to section plane AA shown in FIG. 1.

FIG. 1 shows a lock 1 comprising a latch 2 rotating about a rotating shaft 11, and a pawl 3 also rotating about its corresponding rotating shaft 10. The latch 2 and the pawl 3 are assembled in a rotating manner in one and the same plane.

Figure 5:
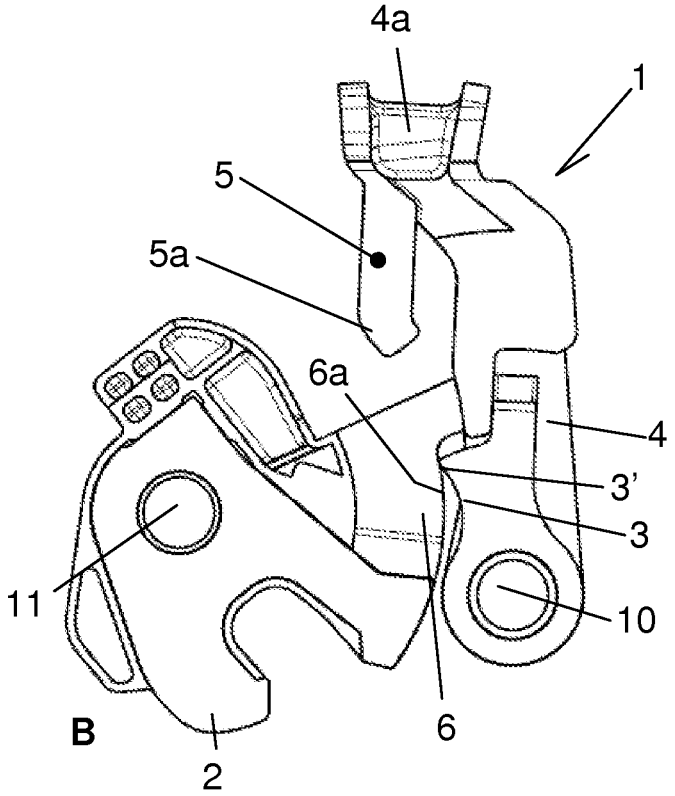

A first spring 7 which tends to rotate the latch 2 from the closed position (A), depicted in FIG. 1, towards an open position (B), depicted in FIG. 5, acts on the latch 2. When the latch 2 adopts the closed position (A), it is configured for retaining a closing anchor, not depicted, and thus preventing the opening of the vehicle trunk. For such purpose, it is contemplated that the lock 1 is installed in the movable element of the vehicle, i.e., in the trunk lid, and that the anchor is integral with the vehicle chassis. Nevertheless, the reverse situation is also contemplated, according to which the lock 1 is installed fixed to the vehicle chassis and the anchor assembled in the movable part, i.e., in the trunk lid.

When the lock 1 is closed, a situation illustrated in FIG. 1, the latch 2 is prevented from rotating in the opening direction by the pawl 3. It can be observed in FIG. 1 how a tooth 3' formed in the contour of the pawl 3 acts by way of a retention ratchet.

With respect to the pawl 3, it is subjected to the action of a second spring 8 applying an anti-clockwise moment thereon, such that it tends to adopt the position of FIG. 1 when it is moved clockwise, which occurs when a user operates the lock 1 to open the trunk.

In the exemplary lock 1, the pawl 3 is assembled on a movable arm 4, rotating about the same rotating shaft 10 of the pawl 3, the end 4*a* of which is configured for receiving the coupling of transmission means which, operated by a motor, are capable of moving the movable arm 4 and rotating it clockwise when the trunk is to be opened.

A third spring 9 which tends to move the mentioned movable arm 4 towards the latch 2 acts on the movable arm 4, i.e., applying an anti-clockwise moment thereon.

Although this spring 9 is depicted as being arranged axially aligned with the second spring 8, other embodiment variants which do not alter the effect that it performs are contemplated. Therefore, the spring 9 can, for example, be anchored at another point of the support casing of the lock. Alternatively, the second spring 8 can be provided with a suitable configuration so that a first end pin acts on the pawl 3 whereas a second end pin acts on the movable arm 4.

Figure 3:
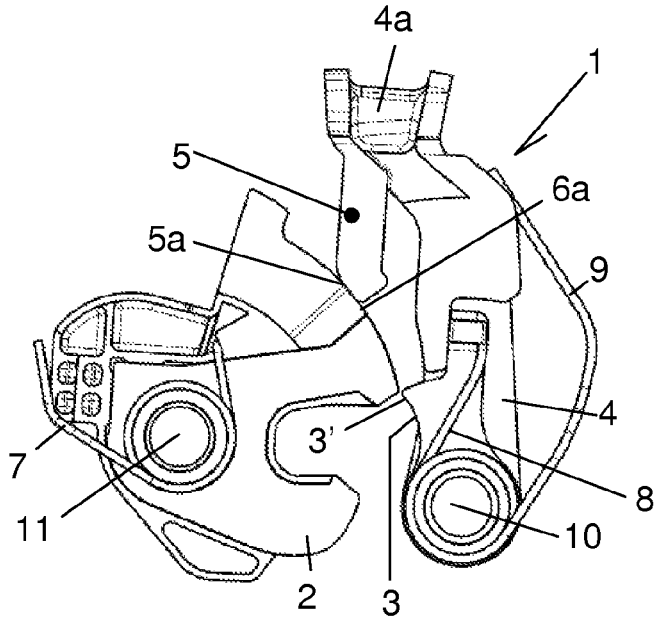
FIGS. 3 to 5 show the sequence of movements which occur during the vehicle trunk opening operation, i.e., when the latch stops adopting the closed position in order to adopt an open position.

In any case and in a known manner, the movable arm 4, commonly called a trigger, and the pawl 3 are linked such that the clockwise rotating movement of the movable arm 4 is transmitted by thrust to the pawl 3, causing the rotation of the pawl 3 until it adopts a release position which is shown in FIG. 3.

As a result of the second spring 8, the pawl 3 in turn rests on the movable arm 4, the movable arm 4 acting as a stop for stopping the anti-clockwise rotation of the pawl 3.

However, the pawl 3 is not prevented from clockwise rotation, so that regardless of whether or not the movable arm 4 is kept in the position depicted in FIG. 1, the pawl 3 can adopt its release position, for example, by means of a manual operation, for which a handle, cable or the like which can be accessed from the vehicle interior is conventionally arranged.

FIGS. 1 to 5 show that the movable arm 4 of the pawl 3 comprises a flange 5 which, when the lock 1 is in the closed position of FIG. 1, is supported by its distal end 5*a* on a smooth surface 6 of the latch 2 adjacent to the edge 6*a* of said latch 2. In this position, the flange 5 is folded slightly upwards, temporarily bent.

When the lock 1 is operated for moving the movable arm 4 and therefore the pawl 3 from the position of FIG. 1 to the release position of FIG. 3, the distal end 5*a* of the flange 5 slides on the mentioned smooth surface 6 of the latch 2 until being released from the latch 2, automatically recovering its stable, non-bent form. Consequently, when the motor stops acting and the movable arm 4 tends to rotate in an anti-clockwise direction as a result of the third spring 9, the flange 5 is applied against the edge 6*a* of the latch 2 preventing the return of the mentioned movable arm 4, and therefore the return of the pawl 3 towards its locked position as a result of the second spring 8.

Therefore, the tooth 3' of the pawl 3 does not interfere with the rotation of the latch 2, so the latter continues to be released, the trunk being able to be opened even when the motor stops acting on the movable arm 4.

Figure 4:
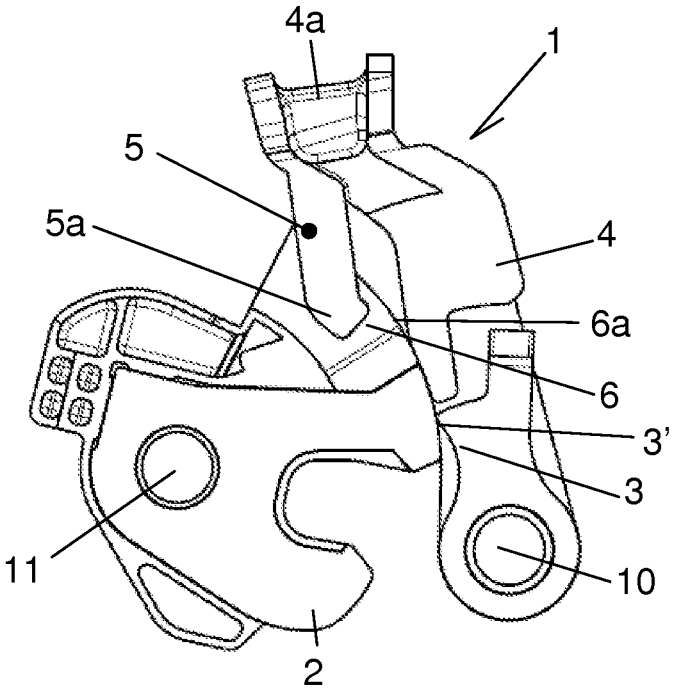

It should be noted that the smooth surface 6 of the latch 2 is configured by way of a ramp (see FIG. 2), reducing the height of the edge 6*a* receiving the support of the flange 5 in a direction contrary to that of the rotation of the latch 2 towards its open position (B), such that the flange 5 can again be arranged on the ramp, allowing the anti-clockwise rotation of the movable arm 4 and of the pawl 3, when a portion of the ramp the smooth upper surface 6 of which is below the level of said flange 5 is arranged facing the flange 5. This situation is depicted by FIG. 4.

By continuing the trunk opening operation, the latch 2 continues to rotate clockwise without any obstacle until reaching the open position (B) of FIG. 5, a position in which the anchor previously retained by the portion configured by way of a hook would be released from the latch 2.

Starting from this open position, during a trunk closing operation, the anchor would push the latch 2 forcing it to rotate anti-clockwise this time, the lock 1 adopting the position of FIG. 1 again in an automatic manner. It must be observed that the flange 5 will initially be arranged on the surface 6 of the latch 2 without sliding thereon, and that once the position of FIG. 4 is reached, it will start to slide on the mentioned surface 6 while being bent again at the same time as a result of the ramp shape of said surface 6.

Advantageously, even when the third spring 9 breaks, the force exerted by the second spring 8 on the latch 3, which is in turn transmitted to the movable arm 4, will be sufficient to load the lock 1 since the ramp shape of the smooth surface 6 of the latch 2 does not offer a hard-to-overcome resistance for repositioning the flange 5 in its bent, operating position on the mentioned surface 6 as illustrated in FIG. 1. It also involves the fact that the force that said ramp exerts on the flange 5 during the trunk closing operation does not follow a fundamentally tangential direction with respect to the rotating shaft 10, but rather a radial direction, so it does not exert, on the movable arm 4 and in turn on the pawl 3, a moment in a direction contrary to that which the second spring 8 exerts thereon, unlike what would occur in the lock according to document DE 102006032033, according to which the step exerts a force on the tab formed in the trigger following an essentially tangential direction with respect to the rotating shaft of the trigger and the associated pawl. This configuration prevents the tab from adopting an operating position again if the force exerted by the spring on the pawl, without the aid of the spring which pushes the trigger, is not sufficient to overcome the reaction force which the step exerts on the tab to arrange it in its operating position.

The invention claimed is:

1. A rotating latch lock, the lock comprising a latch rotating between at least one closed position suitable for retaining a closing anchor, and another open position which releases the anchor, stressed by a first spring in the release direction, and a pawl also rotating between a locked position, in which the pawl retains the latch in the closed position, and another release position, in which the pawl does not interfere with the rotation of the latch, the pawl being subjected to action of a second spring which pushes the pawl to the closed position, the lock further comprising transmission means for moving a movable arm in a direction transmitting a movement to the pawl from the closed position to the release position, the movable arm being linked with the pawl such that the angular position of the movable arm acts as a stop for stopping the rotation of the pawl towards the locked position, wherein the movable arm of the pawl comprises a flange the distal end of which is supported on a smooth surface of the latch adjacent to an edge of the latch, temporarily bending the flange when the latch is in the closed position retained by the pawl, and wherein a length of the flange is such that a distal end of the flange slides on the smooth surface of the latch when the movable arm is moved to push the pawl to the release position, and is released from the latch, so that the flange automatically recovers a stable form, being supported against the edge of the latch and preventing return of the movable arm and therefore of the pawl to the closed position as a result of the second spring.

2. The lock according to claim 1, wherein the smooth surface adjacent to the edge of the latch acting on the flange is configured as a ramp, reducing a height of the edge of the latch in a forward direction contrary to that of the rotation of the latch towards the open position, such that the flange can again be arranged on the ramp, allowing the rotation of the pawl due to the action of the second spring which pushes the pawl to the closed position when a portion of the ramp the smooth upper surface of which is below the level of the flange is arranged facing said flange.

3. The lock according to claim 1, wherein the movable arm is a rotating arm receiving support from the pawl subjected to the action of the second spring, and wherein the lock further comprises elastic means which tend to move the arm towards the latch and that act on the movable arm.

4. The lock according to claim 3, characterized in that the elastic means comprise a spring.

* * * * *